United States Patent [19]

McDowell et al.

[11] 4,042,997

[45] Aug. 23, 1977

[54] VACUUM CLEANER WITH IMPROVED BRUSH

[75] Inventors: David E. McDowell, Grand Rapids; Robert A. Yonkers, Grandville, both of Mich.

[73] Assignee: Bissell, Inc., Grand Rapids, Mich.

[21] Appl. No.: 737,153

[22] Filed: Oct. 29, 1976

[51] Int. Cl.[2] ..... A47L 5/30

[52] U.S. Cl. ..... 15/366; 15/182; 15/383

[58] Field of Search ..... 15/179, 182, 183, 363, 15/364, 366, 383, 386

[56] References Cited

U.S. PATENT DOCUMENTS

| | | | |
|---|---|---|---|
| 2,659,921 | 11/1953 | Osborn | 15/182 |
| 3,939,521 | 2/1976 | Clark | 15/179 |

*Primary Examiner*—Christopher K. Moore

*Attorney, Agent, or Firm*—Andrus, Sceales, Starke & Sawall

[57] ABSTRACT

A vacuum cleaner is provided with a suction nozzle and a cylindrical rotary brush. The brush includes a plurality of generally longitudinally extending rows of uniform bristle tufts. Alternate tufts in alternate rows are spaced at about twice the distance as the remaining more closely spaced tufts and prepare the carpet for sweeping by the latter.

5 Claims, 3 Drawing Figures

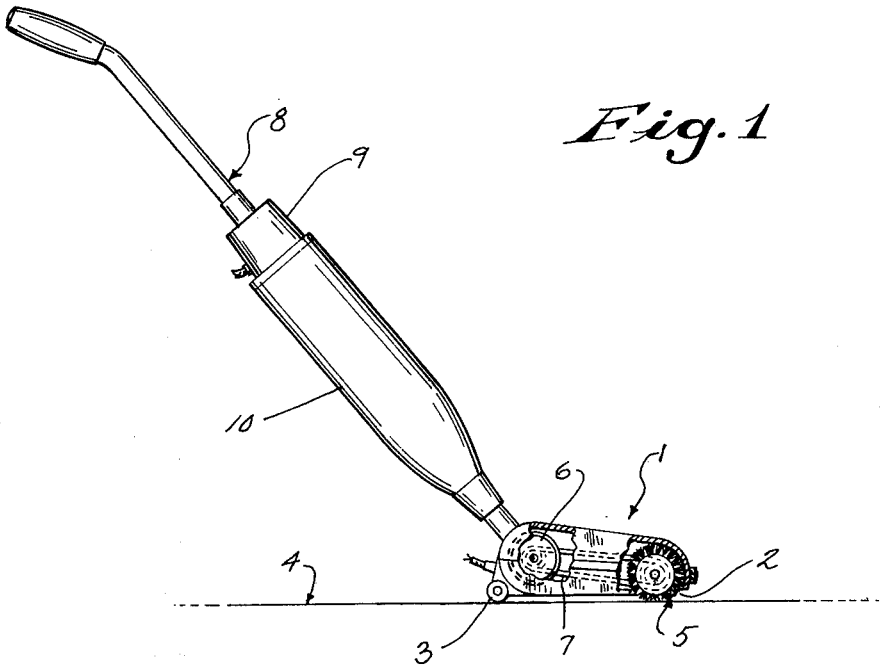
Fig. 1
Fig. 2
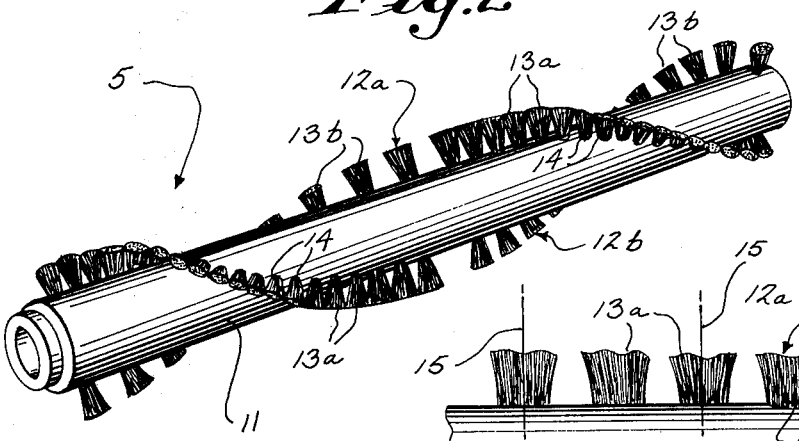
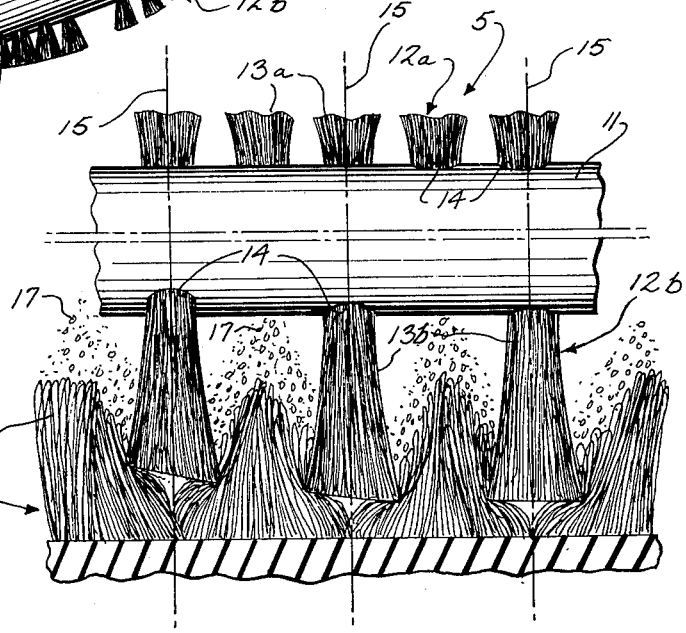
Fig. 3

VACUUM CLEANER WITH IMPROVED BRUSH

PRIOR ART OF INTEREST

U.S. Pat. Nos. 1,044,488, Case, 11/19/12; 1,970,355, Bennet, 8/14/34; 2,281,798, Prince, 5/5/42; 2,459,007, Taylor, 1/11/49; 2,659,921, Osborn, 11/24/53; 3,716,889, Goldstein, 2/20/73; 3,815,170, Brooks et al, 6/11/74.

BACKGROUND OF THE INVENTION

Vacuum cleaners have long been considered one of the most effecient devices for removing debris from carpets and the like. Many modern cleaners, when of the upright type, often comprise a power head portion having a vacuum nozzle, a rotary brush in the nozzle for engaging the carpet, and a brush drive motor; as well as an upright handle or stick pivoted to the head and including a suction motor and a storage chamber for receiving the material removed from the carpet.

The rotary brush has usually comprised a cylindrical core having rows of brush bristle tufts. In many prior constructions, the tufts were arranged longitudinally along the core surface in straight or spiral rows, with adjacent tufts being close together and equally spaced.

Various attempts have been made over the years to improve the ability of the rotary brush to loosen debris on the surface and deep within the carpet so that the material may be readily sucked through the nozzle into the storage means. For example, in the above-mentioned Prince U.S. Pat. No. 2,281,798, a rigid beater bar is used in conjunction with the brush row. In Taylor U.S. Pat. No. 2,459,007, it is suggested to provide alternate rows of short stiff tufts and long flexible tufts. In Osborn U.S. Pat. No. 2,659,921, it is suggested to use three rows of brush bristle tufts, each of a different stiffness. In Goldstein U.S. Pat. No. 3,716,889 it is suggested to provide alternate "agitator elements" in each row, with alternate rigid and resilient elements.

It is readily apparent that all of these "improved" brushes are subject to the disadvantage of increased cost of manufacture, as compared with the aforementioned rotary brush wherein all the rows comprise identical equally spaced tufts of the same length. It is expensive to provide multiple types of tufts or other agitator elements in the same brush and has required special tufting machinery and/or multiple passes through a single machine. Furthermore, rigid agitator elements or beater bars subject the carpet to undesirable wear.

SUMMARY OF THE INVENTION

The present invention solves the aforementioned problems, and is based on the very surprising discovery that complete removal of alternate tufts from alternate tuft rows in a brush wherein the tufts are otherwise all uniform provides a substantially increased cleaning efficiency in a vacuum cleaner of the type indicated. Such a result was wholly unexpected since the normal expectation was the opposite, that is, if bristle tufts were removed from a brush, the brush would not perform as well.

While the present inventors' solution to the aforementioned problems may seem simple in retrospect, it nevertheless has created an improved cleaning concept using a low cost brush which subjects the carpet to less wear.

BRIEF DESCRIPTION OF THE DRAWINGS

The accompanying drawings illustrate the best mode presently contemplated by the inventors for carrying out the invention.

In the drawings:

FIG. 1 is a side elevational view of an upright vacuum cleaner incorporating the concept of the invention, with parts broken away and sectioned;

FIG. 2 is an enlarged perspective view of the rotary brush used in the vacuum cleaner of FIG. 1; and FIG. 3 is an enlarged schematic elevation illustrating the action of the widely spaced tufts on a carpet.

DESCRIPTION OF THE PREFERRED EMBODIMENT

A shown in FIG. 1, the invention is embodied in an upright vacuum cleaner having a power head 1 with a vacuum nozzle 2 at its forward end and wheels 3 at its rear to assist in supporting the cleaner for reciprocating movement over a carpet 4. A rotary brush 5 is suitably mounted within nozzle 2 and is driven by a drive motor 6 through a belt 7.

An elongated handle or stick 8 is pivotally mounted to power head 1, and includes a suction motor 9 and a chamber 10 for receiving debris sucked from the carpet and through nozzle 2.

Referring to FIGS. 1 and 2, brush 5 is in the form of a roller extending transversely of the vacuum cleaner and comprises an elongated cylindrical core 11 of wood or other suitable material and brush means on the core for cleaningly engaging the carpet. The brush means comprises a plurality, such as a pair, of circumferentially spaced single rows **12*a*, 12*b* of flexible brush bristle tufts, 13*a*, 13*b* which extend radially and are suitably anchored in holes 14 formed in the surface of core 11. Rows 12*a* and 12*b* extend generally longitudinally along the core and may take any desirable form, such as the spiral shown. In some embodiments, each row could gradually spiral in one direction from its end to the midsection of core 11**, and then continue to the opposite end in a spiral of reverse direction.

All of the bristle tufts are uniform in diameter, height and other characteristics. They may preferably be made of Nylon, with each bristle having a diameter of about 0.007 inches and an exposed length of about 7/16 inches. Holes 14 are preferably about 0.144 inches in diameter, with a distance between holes of about ¼ inches.

Previous brushes of similar type have been constructed wherein in all rows the tufts were all disposed closely together, in a manner similar to tufts **13*a***. Since a tuft tends to spread out from its base, the outer end of each tuft tended to come very close to or even engage or overlap the adjacent tuft.

In accordance with the concept of the present invention, tufts in alternate circumferentially spaced rows of bristles are spaced at about twice the longitudinal distance from each other as the remaining closely spaced tufts. The widely spaced tufts are disposed in a plurality of spaced parallel transverse planes 15 passing through core 11, said planes also containing every other closely spaced tuft in the circumferentially spaced alternate row. Thus, and in the embodiment of FIG. 2, one end of row **12*a* contains tufts 13*a* spaced closely together a selected distance, while the other end contains tufts 13*b* spaced at about twice the distance of tufts 13*a*. In the alternate row 12*b*, the end portion circumferentially spaced from tufts 13***a* of row 12*a* contains widely spaced tufts 13*b*, while the other end portion circumferentially spaced from tufts 13*b* of row 12*a* contains closely spaced tufts 13*a*.

The brush of the embodiment shown therefor contains rows, half of each having closely spaced tufts and the other half having tufts spaced about twice as far apart. The tuft spacing in circumferentially adjacent rows is reversed. This arrangement has been found to provide excellent dynamic balance of the rotary brush.

Although the number of floor engaging tufts has been substantially reduced with no other elements added, it has been found that the cleaning efficiency of an upright vacuum cleaner of the type disclosed herein on deep pile or plush carpets is increased to a remarkable extent with the improved brush.

Comparative tests using a full-tufted rotary brush and one embodying the inventive concept of FIGS. 1 and 2 have been made. A plush Nylon carpet having ¼ inches cut pile was provided. The carpet was placed in an environment having 30% relative humidity.

In each test, 100 Grams of Wedran 5040 silica sand was distributed over and 18 inches × 54 inches area of the carpet and the sand was rolled into the carpet with 30 strokes. A vacuum cleaner of the type shown schematically in FIG. 1 was provided.

Two 38 second passed were made over the carpet with the vacuum cleaner, and the amount of sand removed was weighed after each pass, thus giving a % of cleaning efficiency for each pass. The results of two complete test runs using both types of brushes are shown as follows:

TEST I

| Brush Type | % of Cleaning Efficiency Pass 1 | Pass 2 |
|---|---|---|
| Full Tufted Brush | 49% | 63% |
| Brush of the Invention | 55% | 73% |
| % Increase in Efficiency | 12% | 16% |

TEST II

| Brush Type | % of Cleaning Efficiency Pass 1 | Pass 2 |
|---|---|---|
| Full Tufted Brush | 50% | 62% |
| Brush of the Invention | 64% | 75% |
| % Increase in Efficiency | 28% | 21% |

The results of TESTS I and II clearly show that removal of every other tuft in alternate rows of tufts increases the cleaning efficiency by a surprising amount under the conditions stated.

It is believed that the previous full tufted brush, which forms a substantially continuous line of tuft ends in each row, tend to press the carpet flat for the full length of the brush so that debris is loosened primarily at or near the surface of the carpet before being swept into nozzle 6. However, and as illustrated in FIG. 3, the widely spaced tufts 13*b* of the brush of the invention are permitted to penetrate deeply into the deep pile nap 16 of carpet 4 in a discontinuous line during driven brush rotation and remove imbedded debris 17 by sweeping the bottom and sides of the depressions so formed. This action brings the debris to near or at the top of the nap and prepares the latter for a full-width sweeping action by the next row of closely spaced tufts.

As a result of the present invention, carpet cleaning efficiency is substantially increased without adding to the power requirements or cost of manufacture of the vacuum cleaning device. In fact, the cost may actually be lowered, because fewer brush bristle tufts are needed.

Various modes of carrying out the invention are contemplated as being within the scope of the following claims particularly pointing out and distinctly claiming the subject matter which is regarded as the invention.

We claim:

1. A vacuum cleaner comprising:

a. a head member adapted for reciprocable movement over a carpet, b. an elongated carpet engaging nozzle disposed in said head member, c. means for creating suction at the nozzlecarpet interface to move debris through said nozzle, d. a handle on said head member, e. and a rotatably driven brush disposed in said nozzle and engageable with the carpet, said brush comprising:

1. an elongated cylindrical core,
2. and a plurality of generally longitudinally extending circumferentially spaced rows of flexible brush bristle tufts extending radially outwardly from said core,
3. said tufts being of the same height and strength,
4. at least a portion of the tufts in alternate rows being equally and closely spaced a selected distance to form a substantially continuous line,
5. the tufts disposed circumferentially from said closely spaced tufts being widely and equally spaced at twice said selected distance, f. said widely spaced tufts forming means to penetrate the carpet in a discontinuous line during driven brush rotation to loosen deeply embedded debris and prepare the carpet surface for subsequent debris removal by said closely spaced tufts as said vacuum cleaner is moved across the carpet.

2. The vacuum cleaner of claim 1 wherein said widely spaced tufts are disposed in a plurality of spaced parallel transverse planes passing through said core, said planes containing every other of said closely spaced tufts.

3. The vacuum cleaner of claim 2:

a. wherein one-half of each said row contains said widely spaced tufts and the other row half contains said closely spaced tufts, b. and wherein the tuft spacing of circumferentially adjacent rows is reversed.

4. A rotatable brush adapted to be drivingly disposed in the nozzle of a vacuum cleaner, such brush comprising:

a. an elongated cylindrical core, b. and a plurality of generally longitudinally extending circumferentially spaced rows of flexible brush bristle tufts extending radially outwardly from said core, c. said tufts being of the same height and strength, d. at least a portion of the tufts in alternate rows being equally and closely spaced a selected distance to form a substantially continuous line, e. the tufts disposed circumferentially from said closely spaced tufts being widely and equally spaced at twice said selected distance, f. said widely spaced tufts forming means to penetrate the carpet in a discontinuous line during driven brush rotation to loosen deeply embedded debris and prepare the carpet surface for subsequent debris removal by said closely spaced tufts.

5. The brush of claim 4:

a. wherein one-half of each said row contains said widely spaced tufts and the other row half contains said closely spaced tufts, b. and wherein the tuft spacing of circumferentially adjacent rows is reversed.

* * * * *